US005805766A

United States Patent [19]

Wang

[11] Patent Number: 5,805,766

[45] Date of Patent: Sep. 8, 1998

[54] HEAT RELEASING BAG WITH SODIUM ACETATE SOLUTION AND ELECTRIC HEATING ELEMENT PRODUCING INFRARED RADIATION

[76] Inventor: Chi-Tu Wang, No. 1, Alley 6, Lane 244, Hsin Shu Rd., Hsinchuang City, Taipei Hsien, Taiwan

[21] Appl. No.: 660,449

[22] Filed: Jul. 7, 1996

[51] Int. Cl.[6] ..... F24J 1/00

[52] U.S. Cl. ..... 392/343; 219/530; 219/528; 392/346; 126/263.01

[58] Field of Search ..... 219/530, 527, 219/528, 549, 211; 392/343, 339, 340, 346; 126/263.01, 204, 263.03, 400; 607/96, 108–112, 114; 36/2.6

[56] References Cited

U.S. PATENT DOCUMENTS

| | | | |
|---|---|---|---|
| 2,114,396 | 4/1938 | McFarlan et al. | 219/528 |
| 3,202,801 | 8/1965 | Saluri | 219/530 |
| 4,077,390 | 3/1978 | Stanley et al. | 126/400 |
| 4,295,517 | 10/1981 | Guex et al. | 165/1 |
| 4,572,158 | 2/1986 | Fiedler | 126/263.04 |
| 4,672,178 | 6/1987 | Wada et al. | 126/400 |
| 4,680,822 | 7/1987 | Fujino et al. | 607/96 |
| 4,777,346 | 10/1988 | Swanton, Jr. | 83/901 |
| 4,880,953 | 11/1989 | Manker | 219/759 |
| 5,205,278 | 4/1993 | Wang | 607/114 |
| 5,534,020 | 7/1996 | Cheney, III et al. | 607/108 |

FOREIGN PATENT DOCUMENTS

| | | | |
|---|---|---|---|
| 2826353 | 12/1979 | Germany | 607/108 |
| 2-172476 | 7/1990 | Japan | 607/114 |
| 3-37058 | 2/1991 | Japan | 607/114 |
| 2272969 | 6/1994 | United Kingdom . | |

*Primary Examiner*—John A. Jeffery
*Attorney, Agent, or Firm*—Bacon & Thomas

[57] ABSTRACT

A heat releasing chemical bag including a flexible water-tight bag, sodium acetate solution contained in the flexible bag, a triggering element mounted in the flexible bag and dipped in sodium acetate solution to activate sodium acetate solution, causing it to crystallize and to release heat during its crystallization, an electric heating element mounted in an electrically insulative container inside the poly bag and controlled to heat crystallized sodium acetate, causing it to be reduced to liquid state. Furthermore, a ceramic paste is contained in the electrically insulative container and completedly surrounds the electric heating element and activated to produce far-infrared rays when the electric heating element is to a source of electric power.

4 Claims, 2 Drawing Sheets

HEAT RELEASING BAG WITH SODIUM ACETATE SOLUTION AND ELECTRIC HEATING ELEMENT PRODUCING INFRARED RADIATION

BACKGROUND OF THE INVENTION

The present invention relates to a heat releasing chemical bag, and relates more particularly to such a heat releasing chemical bag which produces far-infrared rays when releases heat during a chemical reaction.

The technique of producing heat by causing a chemical solution, for example, sodium acetate solution, to crystallize has been well known. The application of this technique is seen in for example, U.S. Pat. No. 4,077,390; U.S. Pat. No. 4,572,158; U.S. Pat. No. 5,205,278; U.S. Pat. No. 4,880,953. These disclosures teach the use of thin metal plates as triggering elements for trigging sodium acetate solution when alternatively bent inwards and backwards, causing sodium acetate solution to crystallize and to release heat during its crystallization. However, these disclosures do not provide any means adapted for causing crystallized sodium acetate to reduce to liquid state for a repeated use. U.S. Pat. No. 4,295,517 discloses the method of using microwaves or boiling water to heat a crystallized chemical, causing it to be reduced to liquid state. This heating method tends to cause the chemical bag to break. Furthermore, it is difficult to control the heating temperature during heating. U.S. Pat. No. 4,295,517 teaches the use of an electric heating element in a chemical bag for heating crystallized sodium acetate, causing it to be reduced to liquid state. However, the installation of an electric heating element in a chemical bag must be carefully protected so that heat can be efficiently transmitted to crystallized sodium acetate.

SUMMARY OF THE INVENTION

It is one object of the present invention to provide a heat releasing chemical bag which produces far-infrared rays for physical therapy when it is activated to release heat for warming the body. It is another object of the present invention to provide a heat releasing chemical bag which uses an electric heating element to heat crystallized sodium acetate for a repeated use. It is still another object of the present invention to provide a heat releasing chemical bag which can be used outdoors, and connected to the car battery power supply circuit to reduce crystallized sodium acetate for a repeated use. It is still another object of the present invention to provide a heat releasing chemical bag which uses a flexible, electrically insulative container to hold the electric element thereof on the inside to prevent a leakage of electricity.

DETAILED DESCRIPTION OF THE PREFERRED EMBODIMENT

Figure 1:
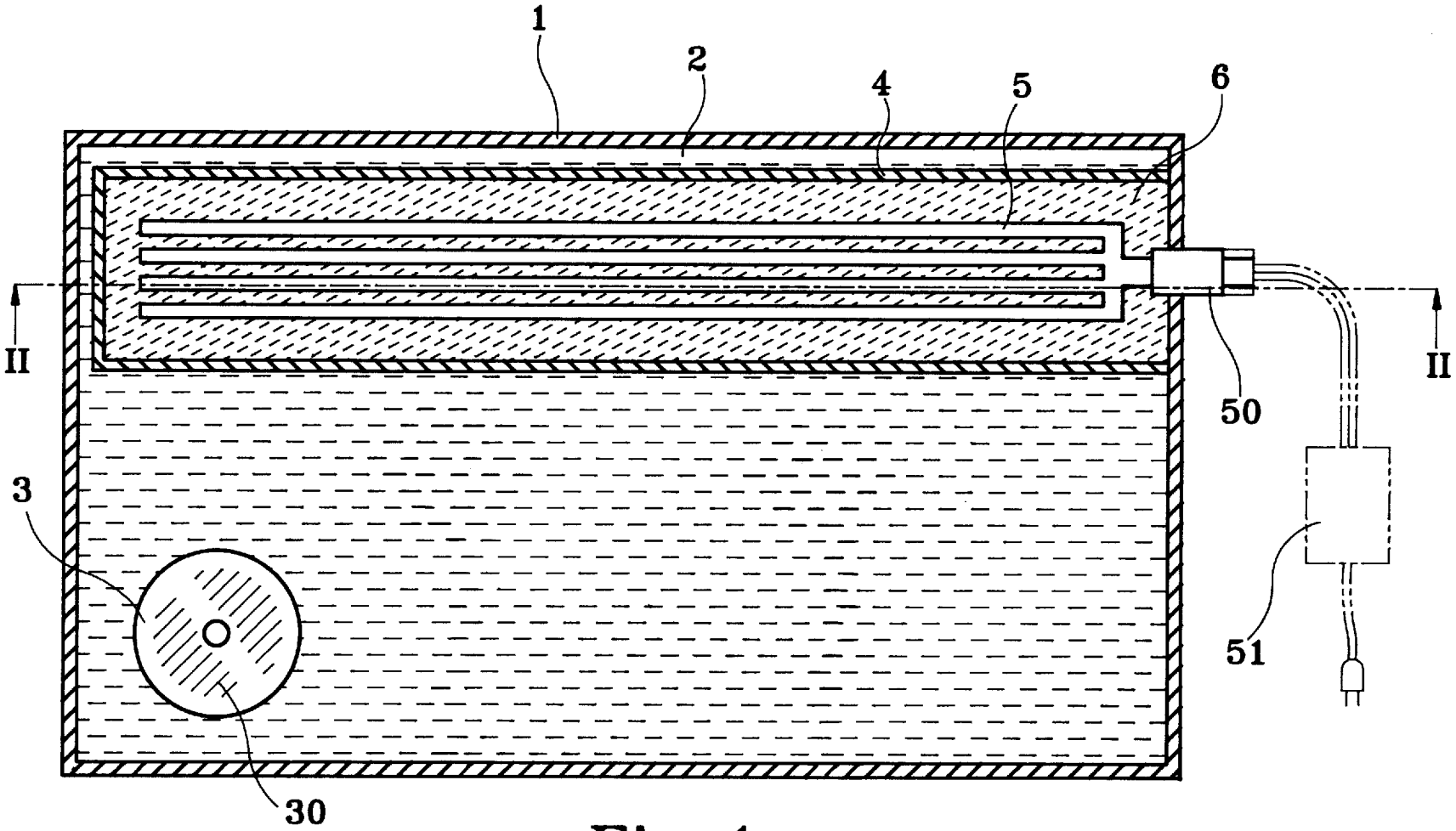
FIG. 1 is a plain view of the present invention, showing the internal structure of the heat releasing chemical bag.
Figure 2:
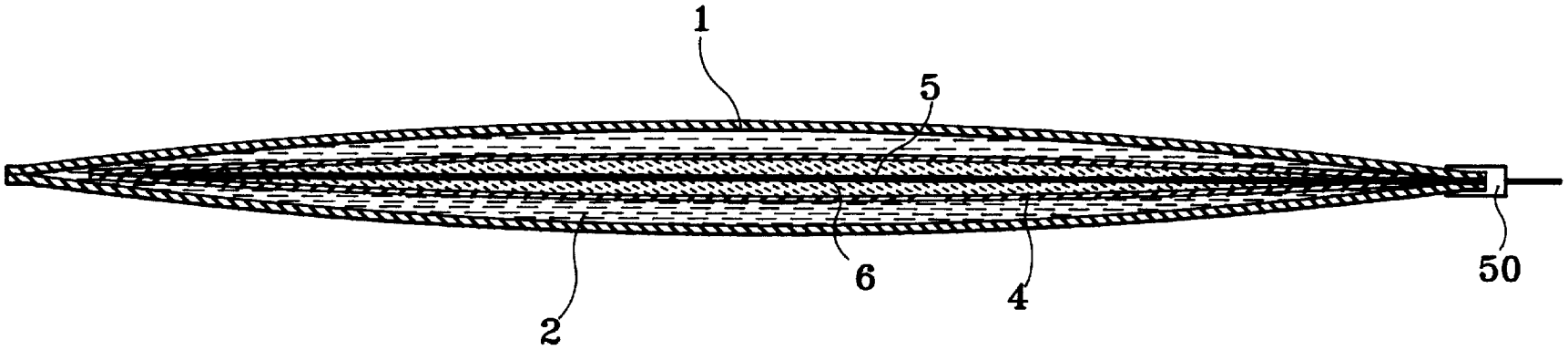
FIG. 2 is a sectional view taken along line II—II of FIG. 1.

Referring to FIGS. 1 and 2, a heat releasing chemical bag in accordance with the present invention is generally comprised of a flexible, water-tight bag 1, sodium acetate solution 2 contained in the water-tight bag 1, a triggering element 3 mounted inside the water-tight bag 1 and dipped in sodium acetate solution 2, a flexible container 4 mounted within the water-tight bag 1, an electric heating element 5 mounted in the flexible container 4, and a ceramic paste 6 contained in the flexible container 4 around the electric heating element 5. The electric heating element 5 and the ceramic paste 6 are separated from the sodium acetate solution 2 by the flexible container 4.

The water-tight bag 1 is preferably made by sealing two films of polyvinyl chloride or like material together. The flexible container 4 is made from similar material. The ceramic paste 6 is a paste containing ceramic powder which produces far-infrared rays for activating the water content of human body when heated. The triggering element 3 is thin metal plate having a corrugated wall 30. When the triggering element 3 is alternatively bent inwards and outwards, vibration waves are produced to activate sodium acetate solution 2, causing it to crystallize and to release heat when crystallizing. When the electric heating element 5 is connected to an electric connector 50, which is disposed on the outside of the bag 1 for the connection of a power supply device 51. The power supply device 51 can be a transformer which converts AC city power supply to DC power supply for the electric heating element 5. Alternatively, the power supply device 51 can be an adapter for connecting the DC power supply circuit of a motor vehicle to the electric heating element 5. When the electric heating element 5 is electrically connected, a heat energy is produced and provided to the crystallized sodium acetate, causing it to be reduced to its former liquid state.

I claim:

1. A heat releasing chemical bag comprising: a flexible, water-tight bag; a flexible, electrically insulative container mounted in said water-tight bag; sodium acetate solution contained in said flexible, water-tight bag; at least one triggering element respectively mounted in said water-tight bag and immersed in said sodium acetate solution, and adapted for bending by hand to vibrate said sodium acetate solution, causing said sodium acetate solution to crystallize and to release heat during its crystallization; an electric heating element mounted in said electrically insulative container and controlled to heat crystallized sodium acetate, causing said sodium acetate crystals to be reduced to liquid state; wherein a ceramic paste is contained in said electrically insulative container and completely surrounds said electric heating element and adapted for producing far-infrared rays when said electric heating element is electrically connected to a source of electric power.

2. The heat releasing chemical bag of claim 1, wherein the triggering element is a thin metal plate having a corrugated wall.

3. The heat releasing chemical bag of claim 1, wherein the source of electric power is a transformer which converts alternating current to direct current.

4. The heat relasing chemical bag of claim 1, wherein the source of electric power is an adapter for connecting to an automotive vehicle direct current power supply.

* * * * *